US007024147B2

(12) United States Patent
Sugawara et al.

(10) Patent No.: US 7,024,147 B2
(45) Date of Patent: Apr. 4, 2006

(54) FIXING DEVICE USING A ROTARY BODY AND IMAGE FORMING APPARATUS INCLUDING THE SAME

(75) Inventors: Tomoaki Sugawara, Kanagawa (JP); Tatsuya Satoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 120 days.

(21) Appl. No.: 10/776,288

(22) Filed: Feb. 12, 2004

(65) Prior Publication Data

US 2004/0165917 A1 Aug. 26, 2004

(30) Foreign Application Priority Data

Feb. 20, 2003 (JP) ..... 2003-042276

(51) Int. Cl.
*G03G 15/20* (2006.01)

(52) U.S. Cl. ..... 399/333; 430/124

(58) Field of Classification Search ..... 399/333; 430/124

See application file for complete search history.

(56) References Cited

U.S. PATENT DOCUMENTS 5,133,849 A 7/1992 Kinoshita et al.
5,427,668 A 6/1995 Sato et al.
5,534,063 A 7/1996 Maruyama et al.
5,622,904 A 4/1997 Ohkubo et al.
5,642,550 A 7/1997 Maruyama et al.
5,896,612 A 4/1999 Maruyama et al.
5,897,726 A 4/1999 Shinkai et al.
6,080,255 A 6/2000 Shinkai et al.
6,156,127 A 12/2000 Maruyama et al.
6,493,529 B1 12/2002 Umemura et al.
6,733,943 B1 * 5/2004 Finn et al. ..... 430/124
6,821,626 B1 * 11/2004 Davis et al. ..... 428/421

* cited by examiner

*Primary Examiner*—Arthur T. Grimley
*Assistant Examiner*—Ryan D. Walsh
(74) *Attorney, Agent, or Firm*—Oblon, Spivak, McClelland, Maier & Neustadt, P.C.

(57) ABSTRACT

A fixing device for an image forming apparatus of the present invention includes a rotary body and a pressing member pressed against each other for conveying a recording medium, carrying a non-fixed toner image thereon, while nipping it therebetween. The rotary member includes an under layer and a surface layer formed of resin. The surface layer has two or more phases including a phase strongly adhering to the under layer and another layer contacting the above phase.

17 Claims, 8 Drawing Sheets

FIG. 6

| PFA : PEEK (WEIGHT RATIO) | PEEL STRENGTH (STANDARDIZED FOR 100% PFA = 1) | TONER PEEL STRENGTH (STANDARDIZED FOR 100% PFA = 1) |
|---|---|---|
| 100 : 0 | 1.0 | 1.00 |
| 95 : 5 | 1.2 | 0.62 |
| 90 : 10 | 4.3 | 0.52 |
| 85 : 15 | 5.1 | 0.53 |
| 80 : 20 | 5.2 | 0.55 |
| 75 : 25 | 5.5 | 0.70 |
| 70 : 30 | 6.0 | 0.80 |
| 0 : 100 | 6.2 | TONER DEPOSITED ON ROLLER SURFACE |

FIG. 7

| PFA : PES (VOLUME RATIO) | TONER DEPOSITION | SURFACE ROUGHNESS Rz ($\mu$m) |
|---|---|---|
| 30 : 70 | SOME | 5.3 |
| 40 : 60 | SOME | 4.5 |
| 50 : 50 | NONE | 2.2 |
| 60 : 40 | NONE | 1.8 |
| 70 : 30 | NONE | 2.1 |

FIG. 8

| PRESSURE (kgf / $cm^2$) | TONER DEPOSITION | SHEET WRAPPING |
|---|---|---|
| 0.3 (kgf / $cm^2$) | NONE | NONE |
| 0.5 (kgf / $cm^2$) | NONE | NONE |
| 1.0 (kgf / $cm^2$) | NONE | NONE |
| 2.0 (kgf / $cm^2$) | SOME | NONE |
| 4.0 (kgf / $cm^2$) | MUCH | FREQUENT JAM |

FIG. 9

| PFA : PES (VOLUME RATIO) | COLD OFFSET TEMPERATURE | HOT OFFSET TEMPERATURE |
|---|---|---|
| 30 : 70 | 105°C | 190°C |
| 40 : 60 | 105°C | 190°C |
| 50 : 50 | 105°C | 190°C |
| 60 : 40 | 105°C | 190°C |
| 70 : 30 | 110°C | 190°C |
| PFA WITH 3% OF CARBON (COMPARISON) | 130°C | 200°C |

FIXING DEVICE USING A ROTARY BODY AND IMAGE FORMING APPARATUS INCLUDING THE SAME

BACKGROUND OF THE INVENTION

1. Field of the Invention

The present invention relates to a rotary body with a high parting ability, a method and a device for fixing a toner image on a recording medium by using the rotary body, and an image forming apparatus including the fixing device.

2. Description of the Background Art

Various methods and devices have been proposed in the past for fixation to be executed in an electrophotographic image forming apparatus. Among them, a fixing method that causes a rotary body, accommodating a heat source therein, and a pressing body to nip a recording medium carrying a toner image thereon is predominant today. The rotary body for such a fixing method has a surface formed of a material containing fluorocarbon resin or similar parting agent that promotes parting of toner. The recording medium is passed through a nip between the rotary body and the pressing body with the toner image contacting the surface of the rotary body. Thus, the surface of the rotary body, generally referred to as a heat roller or a fixing roller, and the toner image carried on the recording medium contact each other under pressure, so that extremely high thermal efficiency is achievable at the time of fixation. The fixing method can therefore rapidly fix the toner image on the recording medium and is desirably applicable to a high-speed electrophotographic image forming apparatus.

However, the fixing method stated above has some problems left unsolved, as will be described hereinafter. The surface layer of the rotary body is rubbed by the recording sheet under pressure and therefore wears. Further, a peeler configured to prevent the recording medium from wrapping round the rotary body is positioned in the vicinity of the rotary body. If the peeler strongly contacts the surface of the rotary body, then it is apt to peel off the surface layer. This is particularly true with fluorocarbon resin because fluorocarbon resin has a parting ability and is therefore apt to fail to strongly adhere to the under layer. Although a primer layer may be formed between fluorocarbon resin and the under layer, as proposed in the past, it is likely that fluorocarbon resin and primer layer are peeled off by an extraneous force when implemented as thin films stacked one upon the other.

To solve the problems stated above, Japanese Patent Laid-Open Publication No. 2000-298411 proposes a roller including a heat-resistant cover layer containing fluorocarbon resin and baked at 300° C. or above. On the other hand, Japanese Patent No. 3,261,166 discloses a fixing device using a roller that includes a layer containing poly-2,2'-(m-phenylene) -5,5'-bibenzoimidazole (PBI) and fluorine-based high/low molecular weight fluorine compound. In any case, a mixture of such a material and heat-resistant resin is coated on a roller surface in the form of a film.

A problem with the above mixture is that the surface structure of the resulting roller is apt to be irregular, depending on production conditions, and effects the service life of the roller. Further, Laid-Open Publication No. 2000-298411 mentioned above expects the fluorocarbon resin layer to rise to the surface of the heat-resistant resin layer. However, if the fluorocarbon resin layer is thin and has its surface scratched by one cause or another, then a polyimide layer, constituting the heat-resistant resin layer and poor in parting ability, is apt to appear on the surface and form cores on which toner deposits, bringing about a jam.

SUMMARY OF THE INVENTION

It is an object of the present invention to provide a rotary body including a resin surface layer made up of two or more phases strongly adhering to an under layer.

It is another object of the present invention to surely provide the rotary body with a parting ability.

It is another object of the present invention to provide the resin surface layer of the rotary body with high thermal conductivity.

It is another object of the present invention to provide the resin surface layer of the rotary body with high electric conductivity.

It is another object of the present invention to provide a fixing device insuring high image quality with the rotary body and an image forming apparatus including the same.

It is another object of the present invention to provide a fixing method and a fixing device capable of easily implementing a parting ability and an image forming apparatus including the same.

It is still another object of the present invention to provide a reliable fixing method and a reliable fixing device by use of a rotary body having a high parting ability and high durability and an image forming apparatus including the same.

It is yet another object of the present invention to provide a fixing device capable of effectively, surely fixing a developer on a recording medium and an image forming apparatus including the same.

It is further object of the present invention to provide a fixing device capable of effectively fixing a developer on a recording medium within the limit of parting ability available with a parting agent and an image forming apparatus including the same.

In accordance with the present invention, in a rotary body pressed against a pressing body for conveying a recording medium, carrying a non-fixed toner image formed by a developer, while conveying the recording medium at a nip between the rotary body and the pressing body, the rotary body includes an under layer and a resin surface layer having a plurality of phases, which include a phase strongly adhering to the under layer and another phase contacting the above phase.

BRIEF DESCRIPTION OF THE DRAWINGS

The above and other objects, features and advantages of the present invention will become more apparent from the following detailed description taken with the accompanying drawings in which:

FIG. 6 is a table listing toner peel strengths measured in Example 2 of the illustrative embodiment;

FIG. 7 is a table listing amounts of toner deposition and surface roughness observed in Example 3 of the illustrative embodiment;

FIG. 8 is a table showing a relation between the pressure of a roller and the amount of toner deposition and sheet wrapping determined in Example 4 of the illustrative embodiment; and FIG. 9 is a table listing surface temperatures of a roller measured in Example 5 of the illustrative embodiment.

DESCRIPTION OF THE PREFERRED EMBODIMENT

Figure 1:
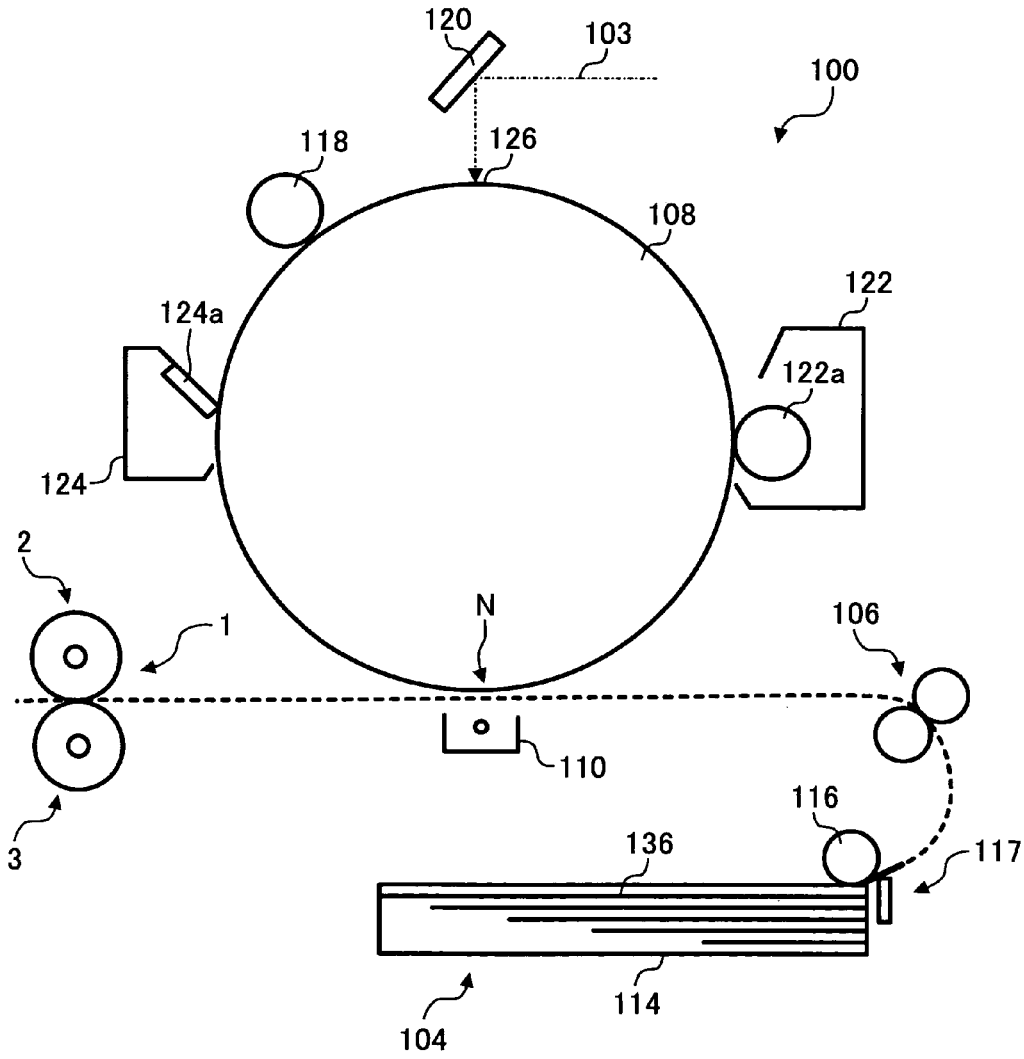
FIG. 1 is a view showing an image forming apparatus including a fixing device embodying the present invention.

Referring to FIG. 1 of the drawings, an image forming apparatus including a fixing device embodying the present invention is shown and implemented as a monochromatic laser printer by way of example. Of course, the image forming apparatus may alternatively be implemented as, e.g., a copier, a facsimile apparatus or a combination thereof and may even be a full-color image forming apparatus. As shown, the laser printer, generally 100, includes a sheet feeding section 104, a registration roller pair 106, a photoconductive drum 108, which is a specific form of an image carrier, image transferring means 110, and a fixing device 1.

The sheet feeding section 104 includes a tray 114 loaded with a stack of sheets or recording media 136, a pickup roller 116 for paying out the top sheet 136 of the stack from the tray 114, and a separating member 117 for separating the sheets 136 underlying the top sheet 136 from the top sheet 136. The sheet 136 paid out by the pickup roller 116 is once stopped by the registration roller pair 106 so as to have its skew corrected thereby. Subsequently, the sheet 136 is again driven by the registration roller pair 106 toward an image transfer position N in synchronism with the rotation of the drum 108, i.e., at such timing that the leading edge of the sheet 136 meets the leading edge of a toner image carried on the drum 108.

A charge roller or charging means 118, a mirror 120, forming part of exposing means not shown, developing means 122 including a developing roller 122*a* configured to feed toner or developer to a latent image formed on the drum 108 and cleaning means 124 including a cleaning blade 124*a* are sequentially arranged around the drum 108 in this order in the direction of rotation of the drum 108. The exposing means scans the surface of the drum 108 with a light beam 103 via the mirror 120 at a position 126 between the charger roller 118 and the developing means 122.

In operation, when the drum 108 is rotated by drive means not shown, the charge roller 118 uniformly charges the surface of the drum 108. The exposing means exposes the charged surface of the drum 108 with the light beam 103 in accordance with image data to thereby form a latent image on the drum 108. The developing means 122 develops the latent image with toner deposited on the developing roller 122*a* for thereby producing a corresponding toner image. The image transferring means 110, applied with a bias for image transfer, transfers the toner image from the drum 108 to the sheet 136 conveyed to the image transfer position N at the timing stated earlier. The sheet 136, carrying the toner image thereon, is conveyed to the fixing device 1 and has the toner image fixed thereby. Thereafter, the sheet or print 136 is driven out to a print tray not shown. Such an image forming procedure is conventional.

Residual toner left on the drum 108 after the image transfer effected at the position N is conveyed to the cleaning means 124 by the drum 108. The cleaning means 124 scrapes off the residual toner with the cleaning blade 124*a*. Subsequently, discharging means, not shown, discharges the surface of the drum 108 to thereby prepare it for the next image formation.

Figure 2:
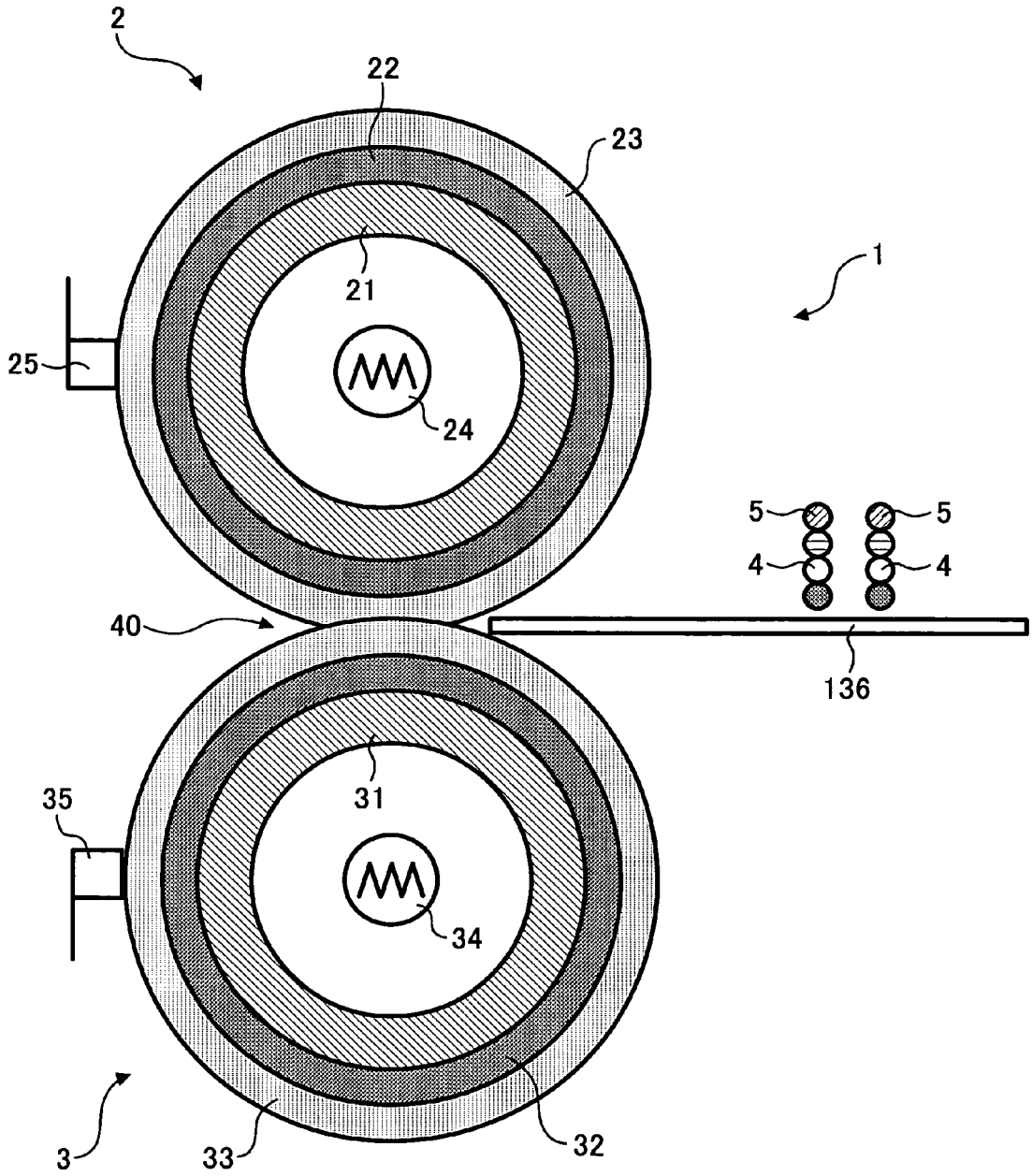
FIG. 2 is a section showing a rotary body included in the fixing device and provided with a surface layer formed of resin.

The fixing device 1 embodying the present invention will be described specifically hereinafter. The fixing device 1 includes a fixing roller or rotary body 2 and a press roller or pressing body 3 pressed against the fixing roller 2. More specifically, as shown in FIG. 2, the fixing roller 2 and press roller 3 respectively comprise hollow, cylindrical cores 21 and 31 formed of metal and halogen heaters or heat sources 24 and 34 accommodated in the cores 21 and 31, respectively. The fixing roller 2 is caused to rotate clockwise, as viewed in FIG. 2, by drive means, not shown, while the press roller 3 is caused to rotate by the fixing roller 2. The fixing roller 2 and press roller 3 cooperate to fix the toner image, which is formed on the sheet 136 by monochromatic solid toner 5, while conveying the sheet 136 via a nip 40 where the two rollers 2 and 3 contact each other.

A surface layer or parting layer 23 is formed on the outer periphery of the core 21 of the fixing roller 2 via a primer layer or under layer 22. Likewise, a surface layer or parting layer 33 is formed on the outer periphery of the core 31 via a primer layer or under layer 32. Temperature sensors 25 and 35 adjoin the fixing roller 2 and press roller 3, respectively, for sensing the surface temperature of the rollers 2 and 3 associated therewith. As shown in FIG. 2, grains of solid wax or parting agent 4 are mixed with the toner grains 5. In the illustrative embodiment, the surface layer 23 formed of resin is characterized in that it is made up of two or more phases, i.e., a phase strongly adhering to the primer layer 22 and another or other layers contacting the above phase.

In the illustrative embodiment, resin applied to the surface layer 23 should preferably be one that is heat-resistant and adheres to the core 21. Such resin may be any one of, e.g., polyamideimide (PAI), poly(ether sulfone) (PES), poly (ether imide) (PEI), poly(ether ether ketone) (PEEK), poly (ether ketone) (PEK), poly(ether nitrile) (PEN), polyarylate (PAR), liquid crystal polymer (LCP), polybenzimidazole (PBI), polyimide (PI) and polyphenylene sulfide (PPS). The heat-resistant resin is used as a solution of a precursor or powder or after being dissolved. Such a solution allows fluorocarbon resin powder to be easily mixed or dispersed therein and can be easily applied to the core 21 with high surface smoothness by dipping or coating. The heat-resistant resin can form a layer on the core 21 if, in the case of thermoplastic resin, a solvent is evaporated or if, in the case of thermosetting resin, it is set after the evaporation of a solvent.

Precursor solutions of PI and PAI are known in the art. Further, PBI dissolves in dimethylacetoamide while PES is dissolvable in dimethylformamide, methylene chloride or N-methyl-2-pyrrolidone, as also known in the art.

Fluorocarbon resin applicable to at least one phase of the surface layer 23 should preferably have a relatively low melting point, preferably between 250° C. and 300° C. For such fluorocarbon resin, use may be made of fine powder of any one of polytetrafluoroethylene (PTFE) with a low molecular weight, tetrafluoroethylene-hexafluoropropyrene copolymer (FEP) and tetrafluoroethylene-perfluoroalkylvinyl ether copolymer (PFA). As for PTFE powder with a low molecular weight, Rubron L-5 and L-2 (trade name) available from DAIKIN INDUSTRIES, LTD. and MP1100, 1200 and TLP-10F-1 (trade name) available from DU PONT-MITSUI FLUOROCHEMICALS CO., LTD are known in the art. FET powder may be implemented by 532-8000 (trade name) available from DU PONT. PFA may be implemented by MP-10 or MP-102 (trade name) also available from DU PONT-MITSUI FLUOROCHEMICALS CO., LTD.

A thermoconductive filler applicable to at least one phase of the surface layer 23 as a thermoconductive layer may comprise any suitable material having a thermal conductivity of $10^{-3}$ cal/s·cm·° C. or above, e.g., diamond, silver, copper, aluminum, marble or glass. It is more practical to use, e.g., silica, alumina, magnesium oxide, boron nitride or beryllium oxide. As for a compound of polyimide resin and PES resin, thermal conductivity is dependent on the amount, shape, size, dispersion condition and so forth of a filler, so that the above filler should preferably be added in an amount of 0.1 part by weight to 50 parts by weight for 100 parts by weight of polyimide resin. An amount less than 0.1 part by weight tends to prevent the filler from exhibiting expected thermal conduction while an amount above 50 parts by weight tends to reduce the area over which the filler adheres to the polyimide resin, which serves as a binder, to thereby noticeably reduce strength.

An electroconductive filler applicable to at least one phase of the surface layer 23 as an electroconductive layer may have a volume resistivity of $10^{10}$ Ω·cm or below. For example, use may be made of polyacetylene, polypyrol, polythiophene or similar conductive polymer, KETJENBLACK, Acetylene Black or similar carbon or graphite, silver, nickel, copper or similar metal or an alloy thereof, composite metal produced by plating mica, carbon or glass, tin oxide, indium oxide or similar metal oxide or anionic, cationic, nonionic or double-property surfactant.

Specific examples of the illustrative embodiment will be described hereinafter.

EXAMPLE 1

Figure 3:
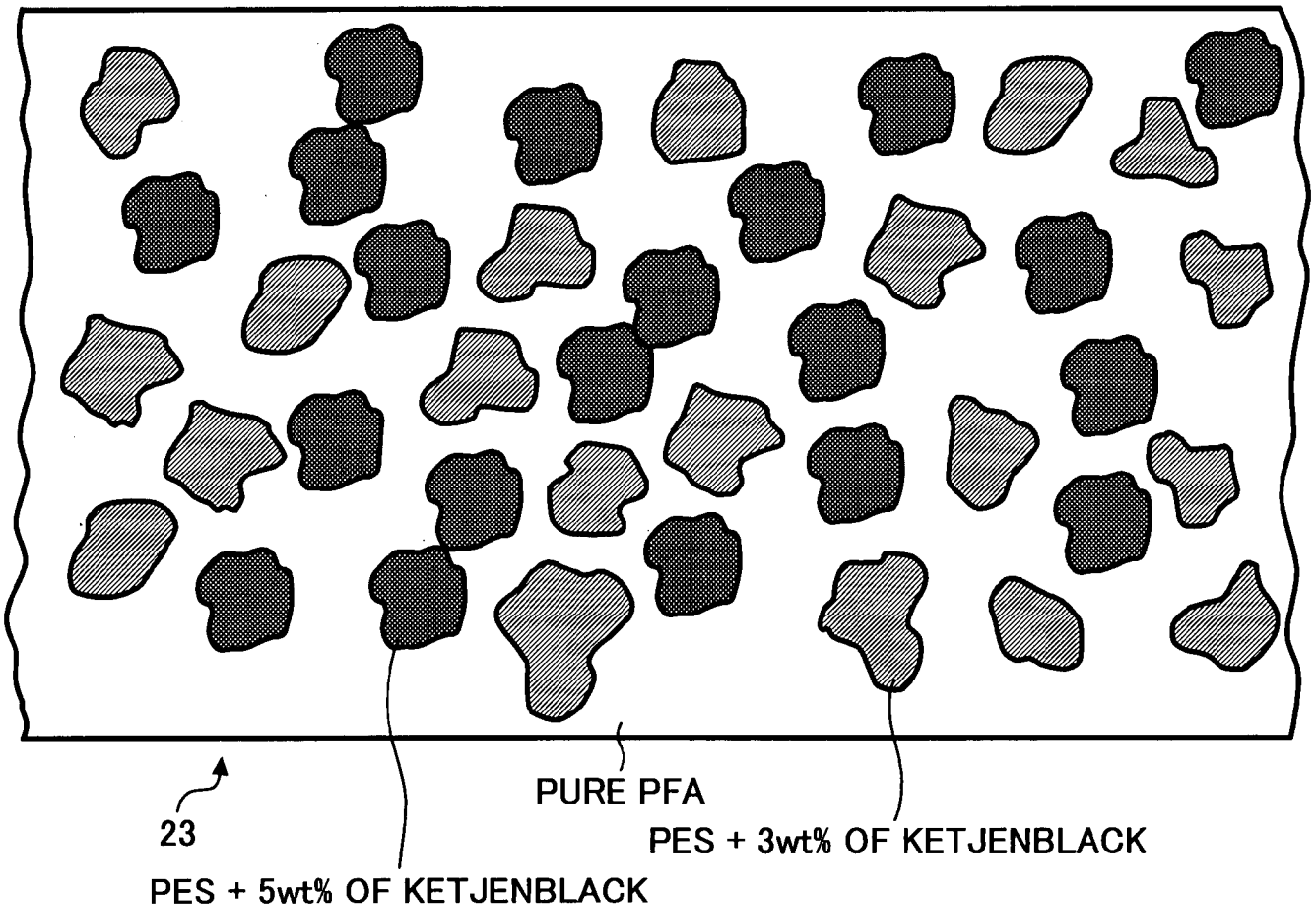
FIG. 3 is an enlarged plan view showing the phases of the surface layer or parting layer of the rotary body.

FIG. 3 shows a surface layer containing two kinds of KETJENBLACK dispersed in PES and a PFA copolymer. PFA is transparent and therefore allows the entire structure of the surface layer to be seen from the above. More specifically, there are shown in FIG. 3 pure PFA, PES with 3 wt % of KETJENBLACK dispersed therein and PES with 5 st % of KETJENBLACK dispersed therein. To produce such a surface layer, PES powder available from SUMITOMO CHEMICAL CO., LTD. was mechanically pulverized to a grain size of 5 μm to 15 μm and then directly applied to an aluminum core by electrostatic coating with an area ratio of 50% without the intermediary of the primer layer 22. The aluminum core had a diameter of 40 mm and a thickness of 1.5 mm, as measured at a fixing portion. The above powder was then caused to adhere to the surface of the core by being heating at 380° C. for about 10 minutes. Subsequently, PFA resin containing KETJENBLACK and available from DU PONT-MITSUI FLUOROCHEMICALS CO., LTD. was electrostatically coated, heated at 380° C. for 30 minutes, and then quenched by a strong air stream outside of a heating furnace. Thereafter, the resulting surface layer was polished by a tape grinder using corundum #800 and #1500 in the circumferential direction of a roller to a surface roughness Rz of 2 μm or below. The surface roughness Rz refers to a ten-point mean roughness as measured by JIS (Japanese Industrial Standards) B0601-1994.

Figure 4:
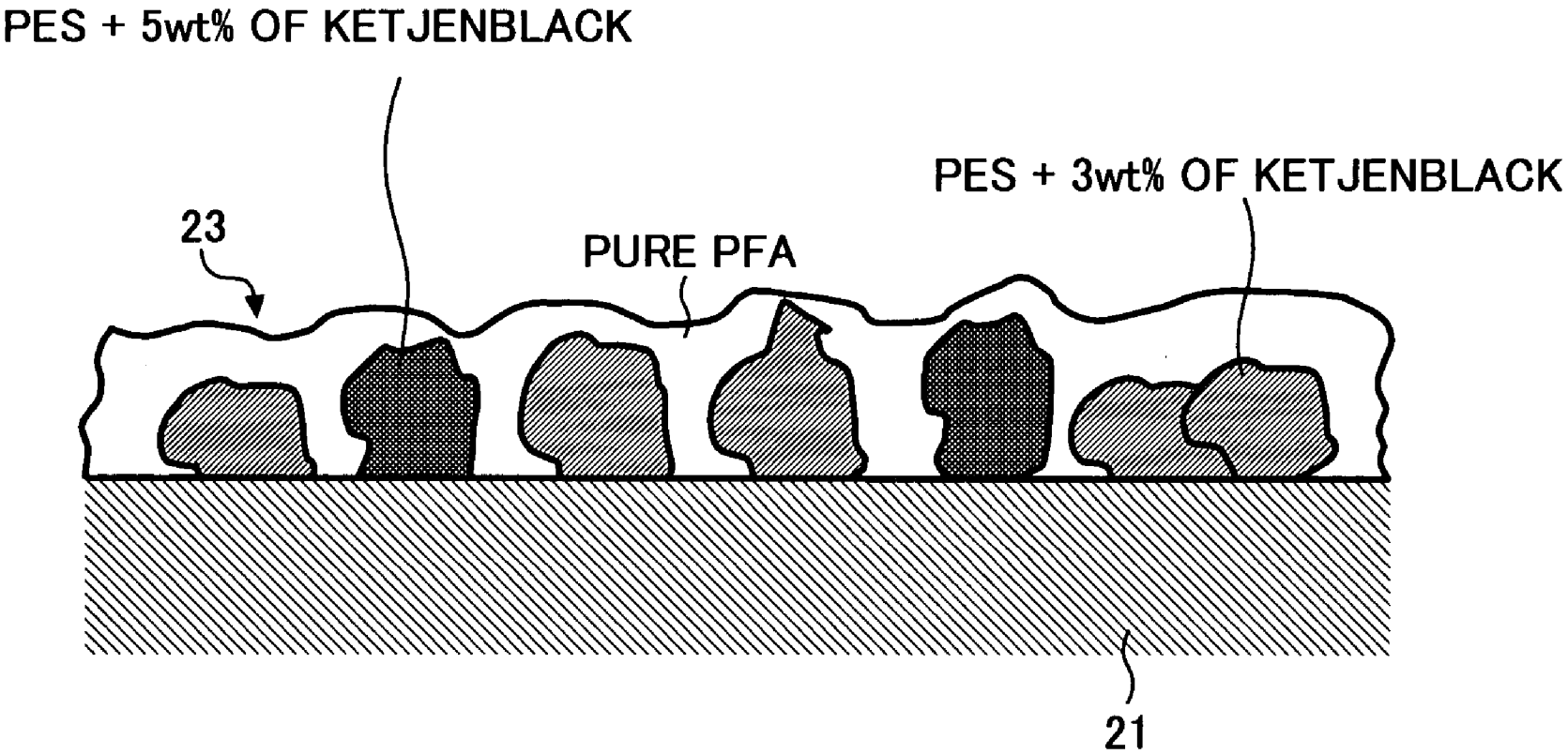
FIG. 4 is a section of the surface layer shown in FIG. 3.

FIG. 4 shows the surface layer of FIG. 3 in a fragmentary section. As shown, PES adhered to the aluminum core or under layer 21 while PFA covered PES in contact therewith. A cut was formed in the surface layer over a width of 10 mm in the circumferential direction of the roller. Subsequently, one edge of the cut was peeled in the direction of 90° away from the roller while being subject to tensile stress. The maximum tensile stress measured was used as peel strength. With the above structure, the surface layer 23 of Example 1 had peel strength about five times as high as that of PFA used alone.

EXAMPLE 2

Figure 5:
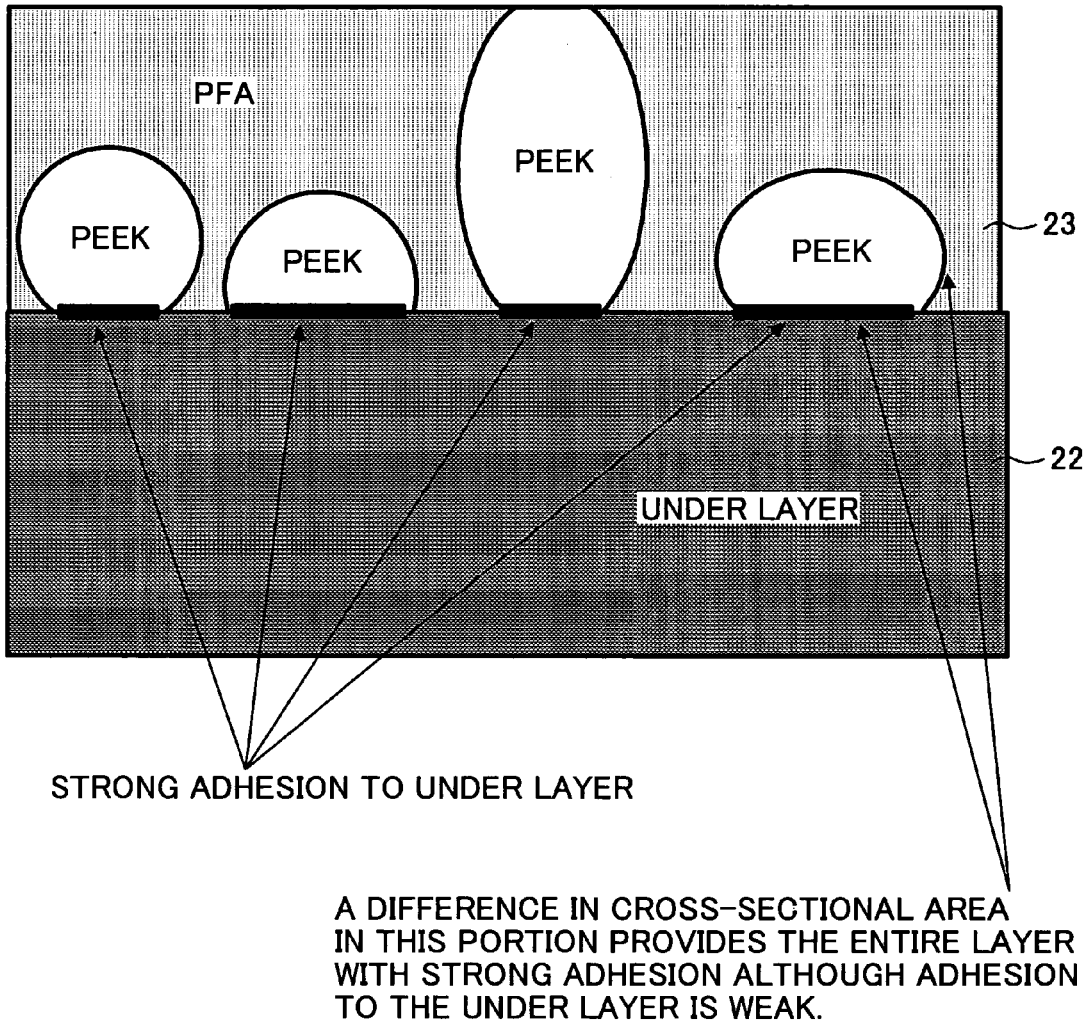
FIG. 5 is a section showing the phases of the surface layer adhering to an under layer.

FIG. 5 is a section a surface layer 23 implemented by PFA and PEEK and produced by the following procedure. First, a solution type primer whose major component was fluorocarbon resin was coated on an aluminum core having a diameter of 40 mm and a thickness of 1.5 mm, as measured at a fixing portion. For such a primer, use may be made of Cookware (A Primer) 459-882 (trade name) available from Du Pont or MP902BN (trade name) available from MITSUI FLUOROCHEMICALS CO., LTD. On the other hand, powder of PFA MP102 available from DU PONT-MITSUI FLUOROCHEMICALS CO., LTD. having a center grain size of 30 μm and powder of PEEK available from VICTREX and provided with grain sizes of 5 μm to 15 μm by mechanical pulverization were mixed together. The ratio of PEEK to PFA by weight was 0%, 5%, 10%, 15%, 20%, 25%, 30%, 35% or 40%. The resulting mixture was coated on the core via the primer by electrostatic coating. Subsequently, the core with the surface layer was heated at 380° C. for 30 minutes and then quenched by a strong air stream outside of a heating furnace. Thereafter, the surface layer was polished by a tape grinder using corundum #800 and #1500 in the circumferential direction of the roller to a surface roughness Rz of 2 μm or below.

Again, a cut was formed in the above surface layer over a width of 10 mm in the circumferential direction of the roller. Subsequently, one edge of the cut was peeled in the direction of 90° away from the roller while being subject to tensile stress. The maximum tensile stress measured was used as peel strength. Measurement showed that the surface layer had peel strength four times or more as high as that of PFA used alone when containing 10% or more of PEEK.

Further, an OHP (OverHead Projector) sheet, carrying a black solid image thereon, was prepared as a recording medium. Subsequently, a 10 mm wide strip was cut away from the sheet and then wrapped round a roller included in a copier MF 4570 (trade name) available from RICOH CO., LTD. and produced by the procedure described above. The roller with the above strip was heated at 120° C. for 10 minutes, cooled off to room temperature, and then peeled off to measure toner peel strength. FIG. 6 lists the results of measurement. As shown, PFA containing 5% to 30% of PEEK, which usually strongly adheres to toner, is lower in toner peel strength than 100% PFA. In this manner, FPA containing PEEK enhances parting of toner and adhesion of the surface layer.

EXAMPLE 3

10 wt % of KETJENBLACK was mixed with PES of Example 1. PFA and such PES were mixed together in five different ratios of 30:70, 40:60, 50:50, 60:40 and 70:30 in volume. The resulting mixtures each were coated on a roller to a thickness of 20 μm, forming a surface layer. The surface layer was then polished by corundum grains with different grains sizes to a surface roughness Rz of 2 μm or below.

The copier MF4570 was loaded with the above roller and continuously operated to output 10,000 black solid images in order to determine the amount of toner to deposit on the roller and surface roughness Rz. FIG. 7 shows the results of observation. As shown, surface roughness Rz is aggravated when the ratio of PFA to PES is 30:70 and 40:60, probably because the toner is wiped off. It will therefore be seen that the roller can be stably used so long as PFA is contained by more than one half.

EXAMPLE 4

A roller was produced in the same manner as in Example 3 and provided with a surface roughness of 2 μm. The ratio of PFA to PES in ratio was 60:40. FIG. 8 shows a relation between the pressure of the roller and the amount of toner deposited on the roller and sheet wrapping. As shown, fixability was extremely low when the pressure was 0.15 kgf/cm$^2$ or below while toner deposited on the roller when the pressure was 4.0 kgf/cm$^2$ or above.

EXAMPLE 5

A roller was produced in the same manner as in Example 3 and provided with a surface roughness of 2 μm. For comparison, a roller with PFA containing 3% of carbon was prepared. FIG. 9 shows surface temperatures of such rollers measured. As shown, The PFA and PES mixture had higher thermal conductivity and therefore implemented fixation at lower temperature than the PFA and carbon mixture.

In summary, it will be seen that the present invention provides a fixing device having various unprecedented advantages, as enumerated below.

(1) A resin surface layer formed on a rotary body includes a phase strongly adhering to an under layer and another layer tridimensionally contacting each other. Therefore, the entire film, forming the resin surface layer, desirably adheres to the rotary body.

(2) A fluorocarbon resin phase with a high parting ability promotes parting of a developer from the rotary body.

(3) A heat conducting function can be assigned to one of two or more phases that transfers heat more efficiently than the other phase when containing a highly thermoconductive filler, so that the thermal conductivity of the entire surface layer is increased. In addition, the parting function, for example, can be assigned to the other phase not joining in heat conduction.

(4) An electricity conducting function can be assigned to one of two or more phases that conducts electricity more efficiently than the other phase when containing a highly thermoconductive filler, so that the electric conductivity of the entire surface layer is increased. In addition, the parting function, for example, can be assigned to the other phase not joining in electricity conduction.

(5) A phase with low adhesion is subject to a wedge type of force due to a difference in sectional area, so that the under layer and resin surface layer peel off little at their interface. The surface layer can therefore strongly adhere to the under layer.

(6) The surface of the rotary body is transferred to an image, particularly a solid image. Therefore, by providing the rotary body with a smooth surface, it is possible to enhance the gloss of the image in the event of fixation.

(7) Wax or similar parting agent contained in a developer allows an image to easily part from the surface layer in the event of fixation.

(8) Fixation effected with many kinds of developers is dependent on pressure to act during fixation. Particularly, fixability is enhanced when a pressure of 0.5 kgf/cm$^2$ or above is applied to a nip between the rotary body and a pressing body.

(9) If the above pressure is 4.0 kgkf/cm$^2$ or above, then wax, silicone or similar parting agent contained in a developer undesirably comes out of toner resin, constituting the developer, and the surface layer or parting layer of the rotary body. Therefore, desirable parting is achievable so long as the pressure is lower than 4.0 kgf/cm$^2$.

(10) The rotary body with high durability and parting ability enhances the reliability of the fixing device, fixing method and image forming apparatus.

Various modifications will become possible for those skilled in the art after receiving the teachings of the present disclosure without departing from the scope thereof.

What is claimed is:

1. A rotary body pressed against a pressing body for conveying a recording medium, carrying a non-fixed toner image formed by a developer, while conveying said recording medium at a nip between said rotary body and said pressing body, said rotary body comprising:

an under layer; and a resin surface layer contacting the under layer, the resin layer comprising a plurality of phases of different resin materials, which include a first phase of a first material configured to strongly adhere to said under layer and a second phase of a second material contacting said first phase and having a higher parting ability.

2. The rotary body as claimed in claim 1, wherein at least the second phase of said resin surface layer contains fluorocarbon resin.

3. The rotary body as claimed in claim 1, wherein said resin surface layer contains fluorocarbon resin and 5% to 30% of poly(ether ether ketone) resin.

4. The rotary body as claimed in claim 1, wherein at least the second phase of said resin surface layer comprises a thermoconductive filler.

5. The rotary body as claimed in claim 1, wherein at least the second phase of said resin surface layer comprises an electroconductive filler.

6. The rotary body as claimed in claim 1, wherein said first phase, strongly contacting said under layer, has a sectional area, which is parallel to a contact portion between said resin surface layer and said under layer within said resin surface layer.

7. The rotary body as claimed in claim 1, wherein said resin surface layer has a surface roughness of 5 μm or below in terms of ten-point surface roughness Rz.

8. The rotary body as claimed in claim 1, further comprising a heat source disposed in said rotary body.

9. A fixing device comprising:

a rotary body; and a pressing body pressed against said rotary body;

said rotary body and said pressing body conveying a recording medium, carrying a non-fixed toner image formed by a multicolor, multilayer developer or a monochromatic solid developer, while conveying said recording medium at a nip between said rotary body and said pressing body to thereby fix said non-fixed image on said recording medium;

said rotary body comprising:

an under layer; and a resin surface layer comprising a plurality of phases of different resin materials, which include a first phase of a first material configured to strongly adhere to said under layer and a second phase of a second material contacting said phase and having a higher Parting ability.

10. The fixing device as claimed in claim 9, wherein the developer comprises toner containing a parting agent.

11. The fixing device as claimed in claim 9, wherein a parting agent is coated on a circumference of at least one of said rotary body and said pressing body.

12. The fixing device as claimed in claim 9, wherein a quotient produced by dividing a pressure F (kgf) acting on the recording medium by an area S ($cm^2$) of a contact portion between said rotary body and said pressing body is 0.5 $kgf/cm^2$ or above.

13. The fixing device as claimed in claim 9, wherein a quotient produced by dividing a pressure F (kgf) acting on the recording medium by an area S ($cm^2$) of a contact portion between said rotary body and said pressing body is 4.0 $kgf/cm^2$ or below.

14. A fixing method comprising:

causing a rotary body and a pressing body, which is pressed against said rotary body, to convey a recording medium, carrying a non-fixed toner image formed by a multicolor, multilayer developer or a monochromatic solid developer, while conveying said recording medium at a nip between said rotary body and said pressing body to thereby fix said non-fixed image on said recording medium, said rotary body comprises:

an under layer; and a resin surface layer comprising a plurality of phases of different resin materials, which include a first phase of a first material configured to strongly adhere to said under layer and a second phase of a second material contacting said phase and having a higher parting ability.

15. The fixing method as claimed in claim 14, wherein the developer comprises toner containing a parting agent.

16. The fixing method as claimed in claim 14, wherein a parting agent is coated on a circumference of at least one of said rotary body and said pressing body.

17. An image forming apparatus for forming a non-fixed toner image by depositing a developer on a latent image formed on an image carrier, transferring said non-fixed toner image to a recording medium and fixing said non-fixed toner image on said recording medium with a fixing device, said fixing device comprising:

a rotary body; and a pressing body pressed against said rotary body;

said rotary body and said pressing body conveying the recording medium, carrying the non-fixed toner image while conveying said recording medium at a nip between said rotary body and said pressing body;

wherein said rotary body comprises:

an under layer; and a resin surface layer comprising a plurality of phases of different resin materials, which include a first phase of a first material configured to strongly adhere to said under layer and a second phase of a second material contacting said phase and having a higher parting ability.

* * * * *